US005707510A

United States Patent [19]

Berry

[11] Patent Number: 5,707,510

[45] Date of Patent: Jan. 13, 1998

[54] CRUDE OIL EMULSION TREATING APPARATUS AND METHOD

[75] Inventor: J. Patrick Berry, Calgary, Canada

[73] Assignee: Kvaerner Process Systems, Inc., Calgary, Canada

[21] Appl. No.: 668,248

[22] Filed: Jun. 20, 1996

[51] Int. Cl.[6] ..... C10M 175/00; C10C 1/20; C10G 17/00

[52] U.S. Cl. ..... 208/184; 196/46; 196/111; 196/134; 422/234; 208/186; 208/187; 208/361

[58] Field of Search ..... 196/46, 46.1, 134, 196/111; 422/234; 208/184, 187, 186, 361

[56] References Cited

U.S. PATENT DOCUMENTS

| | | | |
|---|---|---|---|
| 4,082,653 | 4/1978 | DeGraff | 208/251 R |
| 4,814,044 | 3/1989 | Hitt | 196/98 |
| 4,994,149 | 2/1991 | Scott et al. | 196/104 |
| 4,995,495 | 2/1991 | Krynski | 196/46 |
| 5,098,580 | 3/1992 | Anderson | 210/745 |
| 5,135,616 | 8/1992 | Nicholson et al. | 196/46 |
| 5,543,041 | 8/1996 | Okazaki et al. | 210/181 |

*Primary Examiner*—Nina Bhat
*Attorney, Agent, or Firm*—James G. O'Neill

[57] ABSTRACT

The treating apparatus and method of the present invention improve the efficiency and reliability of flash treating crude oil by including a recycled oil pumping loop that takes crude oil from a flashing section of a vessel and feeds it to either the inlet of a treater section or through a heater into a connecting pipe between the treater section and the flashing section, thereby eliminating the need of a fired heater in the flashing section.

18 Claims, 3 Drawing Sheets

CRUDE OIL EMULSION TREATING APPARATUS AND METHOD

BACKGROUND OF THE INVENTION

1. Field of the Invention

This invention relates generally to apparatus for treating crude oil, and in particular to an improved apparatus and method to improve the efficiency and reliability of flash treatment of crude oil.

2. Description of Related Art

U.S. Pat. No. 4,995,495 to Krynski ("'495") discloses a Crude Oil Emulsion Treating Apparatus having a pressure vessel with two sections. The first section is a conventional heavy oil treater which utilizes heat addition, mechanical coalescence, and electrostatic coalescence to gravity separate most of the water and solids from the oil. The second section is an integral low pressure flash compartment where the remaining water is evaporated and separated from the crude oil. The flash section also contains an internal heater for vaporizing the water remaining in the oil.

The first section or treating section of the '495 patent is typically operated at about 60 to 70 psig and 280° to 300° F. The exact operating conditions are a function of the crude oil properties, but higher temperatures are generally required to reduce the viscosity of heavy oil and higher pressures are required to stay above the saturation pressure of steam at the operating temperature. This prevents foaming in the vessel.

The second or flash section of the '495 patent is typically operated at atmospheric pressure, or up to about 1 to 2 psig, to overcome back pressure in the vapor discharge system. The hot crude oil which may contain small quantities of water, discharges from the treating section and is throttled from 60 or 70 psig down to 1 psig across a control valve. As the pressure is reduced, the heat of the crude oil/water mixture is normally sufficient to vaporize all of the water. The flashing takes place immediately down stream of the control valve. The fluid entering the second section is oil with water vapor. The fired heater in the flash section is not required to vaporize water.

U.S. Pat. No. 1,580,956 to Cameron of Apr. 13, 1926 ("956") teaches the use of recycling a portion of hot dry oil from the bottom of a flash section, re-heating the recycle stream with an external heater, and mixing it with the incoming wet oil. This is recognized as an effective method of maintaining the temperature of the flash section above the boiling point of water. Another effect of this recycle system not recognized by the '956 patent, however, is the reduction in water concentration of the inlet mixture. If larger quantities of hot oil are used, this allows for more water vaporization as the mixture flashes across control valve, such as used in the '495 patent discussed above. However, no such device or method is known to exist, and was not previously considered.

SUMMARY OF THE INVENTION

Accordingly, it is a general object of the present invention to provide an improved oil treating apparatus. It is a particular object of the present invention to reduce the capital and operating costs of a crude oil emulsion treating apparatus by eliminating a fired heater in a flashing section of the apparatus. It is a still more particular object of the present invention to increase the water vaporizing capacity of a crude oil emulsion treating apparatus by incorporating a heated recycle loop from a dry oil outlet of a flashing section back to an inlet of the apparatus. It is a further object of the present invention to increase the operating reliability of a crude oil emulsion treating apparatus during upset conditions and to allow the apparatus to be more flexible and more forgiving to operate. It is still another particular object of the present invention to enhance the capability of a crude oil emulsion treating apparatus to handle foam at an inlet of a flashing section by adding a recycled light hydrocarbon liquid inlet at the top of the flashing section. And, it is yet a still further object of the present invention to provide an improved method of treating crude oil in an apparatus having two separate sections, a treating section and a flashing section.

In accordance with one aspect of the present invention, there is provided an improved oil treating apparatus having a casing means divided into a first treating section and a second flashing section connected together by a pipe having valve means therein. The second flashing section is also connected to an inlet pipe to the first treating section so as to recycle treated oil with entering crude oil at the inlet pipe to the first treating section. The second flashing section may alternatively be connected through a separate external heater to the pipe having valve means therein so as to recycle hot treated oil with crude oil exiting the first treating section, before it enters the flashing section.

The present invention also comprises an improved method of treating crude oil whereby a portion of oil from the second flashing section may be fed to either the inlet to the first treating section or the pipe connecting the first and second sections to improve efficiency and eliminate the need for a heater in the flashing section. Furthermore, a portion of the light hydrocarbon liquids recovered from vapor removed from the second flashing section may be recycled back into the second flashing section.

BRIEF DESCRIPTION OF THE DRAWINGS

The objects and features of the present invention, which are believed to be novel, are set forth with particularity in the appended claims. The present invention, both as to its organization and manner of operation, together with further objectives and advantages, may be best understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved crude oil treating apparatus and method.

Figure 1:
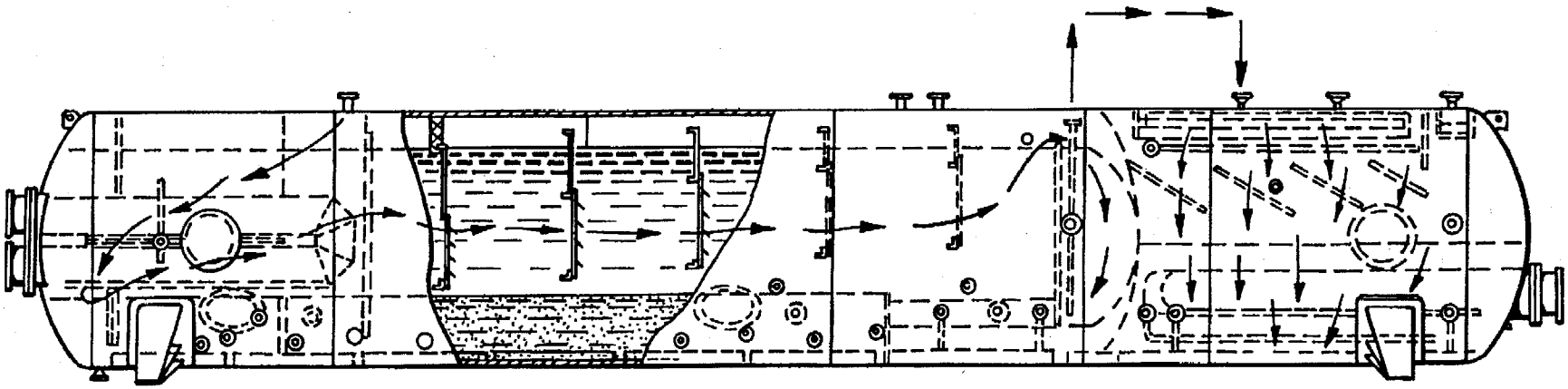
FIG. 1 PRIOR ART
FIG. 1 is a cross sectional elevation view of a prior art crude oil emulsion treating apparatus, such as shown in U.S. Pat. No. 4,995,495.

Turning to FIG.1 of the drawings, the basic apparatus of the present invention remains unchanged except that a fire tube utilized in the flashing section is deleted in the present invention. The disclosure of U.S. Pat. No. 4,995,495 is hereby incorporated in its entirety by this reference thereto.

Figure 2:
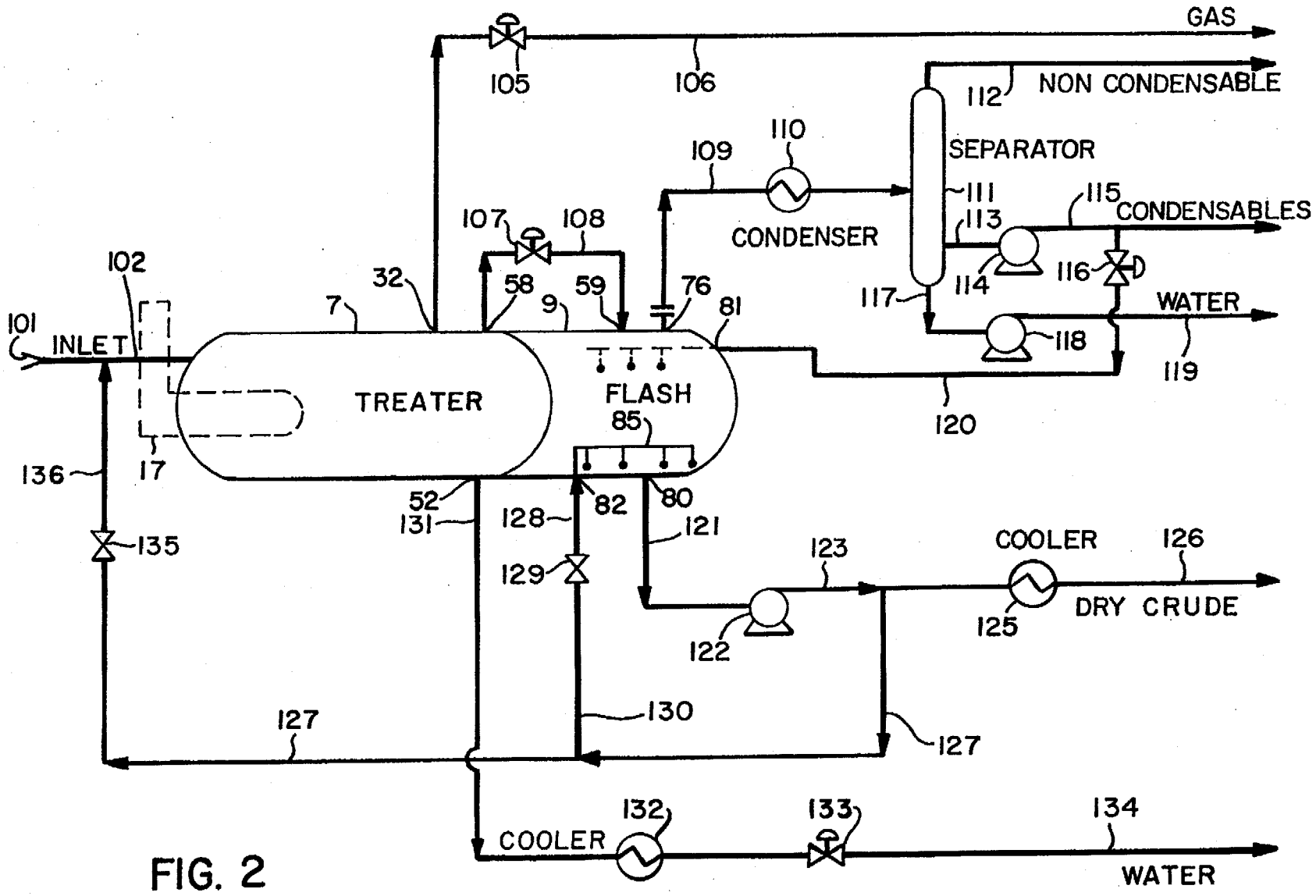
FIG. 2 is a schematic representational view of a first embodiment of the present invention including the apparatus of FIG. 1 connected to external equipment which support its operation, without a fire tube in the flash section, and further showing a recycle oil system, and a recycle light hydrocarbon liquid system.

Referring now to FIG. 2, the system of the present invention consists of a casing means or vessel 1 having an inlet treating section or treater 7 that receives a raw crude oil fluid from an inlet 101 through a line 102. The fluid entering the treating section is a mixture of oil, water, gas, and solids. The treating section 7 operates at pressures from 25 psig up to 100 psig or more and at temperatures of 120° F. up to 310° F. The treating section 7 has one or more fired U tube heaters 17 that can heat the inlet crude oil up to these operating temperatures. Inside the treating section 7 the majority of the water, gas, and solids are removed by gravity. The separated gas is discharged from the vessel via outlet 32, outlet line 106, and control valve 105. The separated water is discharged from the vessel via outlet 52, outlet line 131, cooler 132, control valve 133 and line 134. Solids that settle to the bottom of the vessel are removed by a sand jetting and desand system. Jetting water enters the vessel at multiple inlets (not shown) and sand slurry is removed from the vessel at multiple outlets (not shown).

The partially dehydrated crude oil leaving the treating section 7 may contain small amounts of water (0.5% to 4%) that is separated in the flash or flashing section 9. The crude exits the treating section 7 via outlet 58, passes through control valve 107, and then via line 108 and through inlet 59 to the flash section 9. The flash section 9 operates at near atmospheric pressure. A portion of the sensible heat of the hot crude/water mixture is converted to latent heat of vaporization that turns the water into vapor as the mixture de-pressurizes across the control valve 107. The crude/water mixture cools as the energy is absorbed by the vaporizing water. The amount of temperature reduction depends on the amount of water evaporated. The operating temperature of the flash section 9 is lower than the treating section 7 but is still above the boiling point of water.

During this flashing process a certain amount of low boiling point hydrocarbons are also flashed with the water. These low boiling point hydrocarbons are components of the crude oil and are also vaporized by the pressure reduction and the sensible energy of the mixture.

The fluid entering the flash section 9 at inlet 59 is crude oil, water vapor, and light hydrocarbon vapor.

The flash section 9 is a separator where a water vapor and hydrocarbon vapor mixture exits from the top through an outlet 76. The vapors travel through a line 109 to a condenser 110 where the vapors cool. Condensed water, hydrocarbon, and some non-condensable gases enter a separator vessel 111 where the fluids separate by gravity. Non-condensable gases exit from the top of the separator 111 via a line 112 while the water is pumped from the bottom through a line 117 by a pump 118 and discharged to tankage via a line 119. The light hydrocarbon liquid is withdrawn from the separator 111 from the zone just above the water zone through a line 113 which leads to a pump 114. A portion of the light hydrocarbon liquid can be routed from pump 114 via a line 115 to a line 120 and through control valve 116 back to the flash section 9 where it enters by an inlet 81. The remainder of the light hydrocarbon liquid discharge through the line 115 to storage.

The light hydrocarbon that recycles back to the flash section 9 flows through an internal pipe with nozzles that direct the liquid downward counter current to the vapor flow from inlet 59. The light hydrocarbon mixes with the crude oil and aids in breaking down the foam inside the flash section 9. This assists the separation of vapor from the crude oil.

Dry, hot crude oil is pumped from the bottom of the flash section 9 through an outlet 80 via a line 121. A pump 122 transfers most of the crude through a line 123, a cooler 125, and a line 126 to tankage. A portion of the hot crude oil pumped by pump 122 is recycled via a line 127. The recycled hot oil flows to two different places. Some of the recycled oil flows back into the flash section via a line 130, through a valve 129, and via line 128 where it enters the bottom of the vessel by an inlet 82. This recycled stream of oil flows through an internal pipe 85 and discharges through nozzles directed towards the bottom of the flash section. This maintains circulation in the flash section bottom to keep solids in suspension and prevent them from plugging the oil outlet 80.

The second recycled stream of hot oil flows through line 127 to a valve 135, and then through line 136 back to the inlet line 102 which flows to the treating section 7 inlet. The recycled, dry crude oil from the flash section mixes with the raw inlet crude oil. Within the treating section 7 the recycled oil is heated by the fired U tube 17 along with the incoming raw crude. The recycled oil makes it way through the treating section 7, through the pressure reducing control valve 107, and into the flash section 9 again. In this way the heating means in the treating section 7 provides all of the heat required for the flash section 9 to operate. By adding the mass of dry recycled oil, additional heat can be transferred to the oil/water mixture by the fire tube in the treating section and that which flashes across the control valve 107. This increases the capacity of the unit to vaporize additional water, which is especially important when short term upset conditions occur in the front treating section 7.

Another benefit of bringing the recycled oil back to the treating section 7 inlet is that it reduces the water concentration of the feed stream into the treating section. This reduces the harmful effects of sudden increases in water volumes entering the unit. The unit becomes less susceptible to upsets and more reliable in separating the water from the crude oil.

By feeding some of the recycled oil to the bottom of the flash section 9, through inlet 82, oil in the flash section 9 will be kept warm during no inlet flow conditions. If the unit is shut down for short periods of time the treating section heater can be used to maintain the crude oil at operating temperatures by recycling a small volume of the dry crude from the bottom of the flash section 9 back to the treating section 7 as described above.

Figure 3:
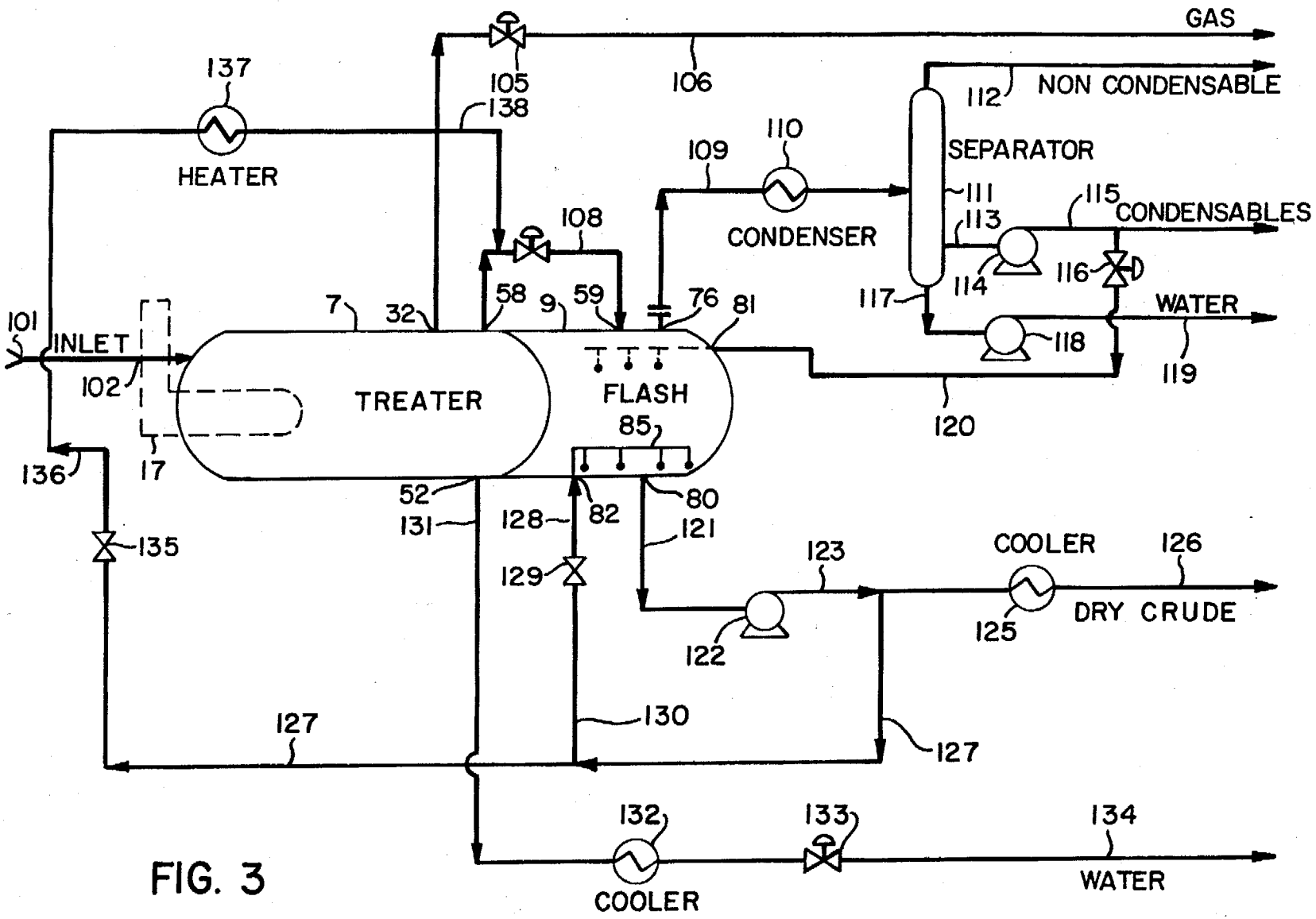
FIG. 3 is a schematic representational view of a further embodiment of the present invention including all of the apparatus of FIG. 2, and showing a further heated recycle loop connected to the flashing section.

Turning now to FIG. 3, there shown is a further embodiment of the present invention including all of the apparatus and connections as shown in FIG. 2, except that line 136 is not connected to inlet line 102 for feeding the recycled oil into the treating section. This embodiment instead has a heated recycle loop with an external heater 137. That is, the recycled oil passes through valve 135 to heater 137, the hot dry oil from heater 137 then travels via line 138 to line 108, where it is connected upstream of the control valve 107 so that the heated oil is mixed with the oil/water mixture exiting treating section 7. Any suitable heating 30 means or method, such as a heat exchanger or fired heater, of a type well known to those skilled in the art may be used.

Those skilled in the art will appreciate the above described preferred embodiments are subject to numerous modifications and adaptations without departing from the scope and spirit of the invention. Therefore, it is to be understood that, within the scope of the appended claims, the invention may be practiced other than as specifically described herein.

What is claimed is:

1. A method of improving the operation of an oil treating apparatus having a treating section and a flashing section connected together by a pipe and a flashing valve, comprising the steps of:

assembling said flashing section with no heating means therein;

passing crude oil through said treating section and said flashing section of said apparatus;

taking some treated oil from said flashing section of said apparatus and passing it through a heating means external to said flashing section for heating said treated oil; and then passing said treated oil to said pipe having said valve therein, before it meets said valve, whereby said heated, treated oil mixes with partially desanded and dewatered crude oil from said treating section.

2. A method of improving the operation of an oil treating apparatus having a treating section and a flashing section connected together by a pipe and a flashing valve, comprising the steps of:

assembling said flashing section with no heating means therein;

passing crude oil through said treating section and the unheated flashing section of said apparatus; and taking some treated oil from said unheated flashing section and passing it to an inlet of said treating section whereby said treated oil mixes with untreated crude oil entering said treating section.

3. An apparatus for treating crude oil comprising casing means; first partition means separating the interior of said casing means into a treating section and a flashing section; inlet pipe means in said casing means for introducing crude oil into the treating section of said casing means; heater means in said treating section for reducing the viscosity of the crude oil; gas outlet means in said casing means for discharging gas from said treating section; desand means in said casing means for discharging sand from said treating section; water outlet means in said casing means for discharging water from said treating section; first trough means proximate said first partition means in said treating section for receiving at least partially desanded and dewatered crude oil; oil outlet means for feeding oil from said trough means to said flashing section; oil inlet means in said flashing section of said casing means; a pipe having a valve therein connecting said oil outlet means from said trough means to said oil inlet means in said flashing section; second trough means in said flashing section of said casing means for receiving oil introduced through said oil inlet means from said first trough means; vapor outlet means in said casing means for discharging water vapor and light hydrocarbon vapor from said flashing section; treated oil outlet means for discharging treated oil from said flashing section; the improvement comprising said flashing section having no heater means therein, and including a recycle line connected through valve means to inlet means in said casing means so as to mix recycled oil from the unheated flashing section with said crude oil in said treating section.

4. The apparatus of claim 3 wherein said inlet means in said casing means is said inlet pipe means to said treating section and said recycled oil is mixed with crude oil entering said treating section.

5. The apparatus of claim 4, further including a second recycle line connected to a vapor separator for removing liquid from said vapor separator and passing said liquid through a further valve means back into said flashing section.

6. The apparatus of claim 5 wherein said liquid removed from said vapor separator and returned to said flashing section is a light hydrocarbon.

7. The apparatus of claim 6 wherein said light hydrocarbon returned to said flashing section flows through an internal pipe having nozzles for mixing with crude oil entering said flashing section.

8. The apparatus of claim 3 wherein said inlet means in said casing is in said pipe having a valve therein connecting said oil outlet means from said trough means to said oil inlet means in said flashing section.

9. The apparatus of claim 8, further including a second recycle line connected to a vapor separator for removing liquid from said vapor separator and passing said liquid through a further valve means back into said flashing section.

10. The apparatus of claim 9 wherein said liquid removed from said vapor separator and returned to said flashing section is a light hydrocarbon.

11. The apparatus of claim 10 wherein said light hydrocarbon returned to said flashing section flows through an internal pipe having nozzles for mixing with crude oil entering said flashing section.

12. The apparatus of claim 3, further including a second recycle line connected to a vapor separator for removing liquid from said vapor separator and passing said liquid through a further valve means back into said flashing section.

13. The apparatus of claim 12 wherein said liquid removed from said vapor separator and returned to said flashing section is a light hydrocarbon.

14. The apparatus of claim 13, further including a light hydrocarbon inlet in said flashing section connected to an internal pipe having a plurality of nozzles therein; said plurality of nozzles directing said light hydrocarbon downward with crude oil entering through said oil inlet means for mixing with said crude oil.

15. An apparatus for treating crude oil comprising casing means; first partition means separating the interior of said casing means into a treating section and a flashing section; inlet pipe means in said casing means for introducing crude oil into the treating section of said casing means; heater means only in said treating section for reducing the viscosity of the crude oil; gas outlet means in said casing means for discharging gas from said treating section; desand means in said casing means for discharging sand from said treating section; water outlet means in said casing means for discharging water from said treating section; first trough means proximate said first partition means in said treating section for receiving at least partially desanded and dewatered crude oil; oil outlet means for feeding oil from said trough means to said flashing section; oil inlet means in said flashing section of said casing means; a pipe having a valve therein connecting said oil outlet means from said trough means to said oil inlet means in said flashing section; second trough means in said flashing section of said casing means for receiving oil introduced through said oil inlet means from said first trough means; vapor outlet means in said casing means for discharging water vapor and light hydrocarbon vapor from said flashing section; treated oil outlet means for discharging treated oil from said flashing section; the improvement comprising said flashing section having no heater means therein, and including a recycle line connected through valve means to said to inlet pipe means to said treating section so as to mix recycled oil from said flashing section with said crude oil entering said treating section; and a second recycle line connected to a vapor separator removing liquid from said vapor separator and passing said liquid through a further valve means back into said unheated flashing section.

16. The apparatus of claim 15, further including a light hydrocarbon inlet in said unheated flashing section connected to an internal pipe having a plurality of nozzles therein; said plurality of nozzles directing said light hydrocarbon downward with crude oil entering through said oil inlet means for mixing with said crude oil.

17. An apparatus for treating crude oil comprising casing means; first partition means separating the interior of said casing means into a treating section and a flashing section; inlet pipe means in said casing means for introducing crude oil into the treating section of said casing means; heater means provided only in said treating section for reducing the viscosity of the crude oil; gas outlet means in said casing means for discharging gas from said treating section; desand means in said casing means for discharging sand from said treating section; water outlet means in said casing means for discharging water from said treating section; first trough means proximate said first partition means in said treating section for receiving at least partially desanded and dewatered crude oil; oil outlet means for feeding oil from said trough means to said flashing section; oil inlet means in said flashing section of said casing means; a pipe having a valve therein connecting said oil outlet means from said trough means to said oil inlet means in said flashing section; second trough means in said flashing section of said casing means for receiving oil introduced through said oil inlet means from said first trough means; vapor outlet means in said casing means for discharging water vapor and light hydrocarbon vapor from said flashing section; treated oil outlet means for discharging treated oil from said flashing section; the improvement comprising said flashing section having no heater means therein and including a recycle line connected through valve means to a heater externally of said casing means and to said pipe having a valve therein connecting said oil outlet means from said trough means to said oil inlet means in the unheated flashing section so as to mix recycled oil from said unheated flashing section with said crude oil exiting said treating section; and a second recycle line connected to a vapor separator removing liquid from said vapor separator and passing said liquid through a further valve means back into said unheated flashing section.

18. The apparatus of claim 17, further including a light hydrocarbon inlet in said unheated flashing section connected to an internal pipe having a plurality of nozzles therein; said plurality of nozzles directing said light hydrocarbon downward with crude oil entering through said oil inlet means for mixing with said crude oil.

* * * * *